US005393033A

United States Patent [19]

Wilson

[11] Patent Number: 5,393,033

[45] Date of Patent: Feb. 28, 1995

[54] ADJUSTABLE SIDE FORM CONCRETE MOLD

[75] Inventor: Charles W. Wilson, Red Oak, Iowa

[73] Assignee: Wilson Concrete Company, Red Oak, Iowa

[21] Appl. No.: 95,609

[22] Filed: Jul. 21, 1993

[51] Int. Cl.[6] ..... B28B 7/02; B28B 7/04

[52] U.S. Cl. ..... 249/155; 249/161; 249/170; 249/172

[58] Field of Search ..... 249/155, 158, 159, 160, 249/161, 170, 172

[56] References Cited

U.S. PATENT DOCUMENTS

| | | | |
|---|---|---|---|
| 787,198 | 4/1905 | Lloyd | 249/155 |
| 911,110 | 2/1909 | Box et al. | 249/155 |
| 942,457 | 12/1909 | Nicolai | 249/155 |
| 1,336,857 | 4/1920 | Porri | 249/155 |
| 3,010,174 | 11/1961 | McCall | 249/50 |
| 3,217,375 | 11/1965 | Kinnard | 425/130 |
| 3,511,467 | 5/1970 | Rohrer | 249/118 |
| 3,523,343 | 8/1970 | Mitchell | 425/88 |
| 3,645,490 | 2/1972 | Beasley | 249/50 |
| 3,704,852 | 12/1972 | Wellander | 249/50 |
| 3,744,184 | 7/1973 | Niemi et al. | 249/161 |
| 3,832,118 | 8/1974 | Leonard et al. | 425/443 |
| 4,004,874 | 1/1977 | Foster | 425/438 |
| 4,289,293 | 9/1981 | Cashion | 249/74 |

FOREIGN PATENT DOCUMENTS

| | | | |
|---|---|---|---|
| 1411149 | 7/1988 | U.S.S.R. | 249/155 |

*Primary Examiner*—James P. Mackey

*Attorney, Agent, or Firm*—Brian J. Laurenzo; Kent a. Herink; Brett J. Trout

[57] ABSTRACT

An adjustable concrete mold which varies the height of a side form on a casting bed to any desired height, The device is also of a construction which allows total exposure of the sides of a hardened concrete element after casting and which allows complete clearance of the side form away from the main bed to allow easy removal of the hardened concrete element from the main bed.

8 Claims, 7 Drawing Sheets

ADJUSTABLE SIDE FORM CONCRETE MOLD

BACKGROUND OF THE INVENTION

The present invention relates generally to concrete molds and, more particularly, to concrete molds with adjustable side forms which act to increase or decrease the depth of the mold.

Concrete molds are used for making a variety of construction components including, but not limited to, modular wall panels. For molding large slabs of concrete a stationary casting surface such as a horizontal panel bed is typically utilized with side forms of the desired height bolted or otherwise secured to the sides of the casting surface. The sides of the mold are oiled or otherwise lubricated with a non-stick material before the concrete is poured into the mold.

After the concrete has been poured, the concrete is typically screed with a strikeoff to remove excess concrete extending beyond the upper portion of the side forms. The concrete may then be scratched or scored depending upon the particular application with which the slab will be utilized. After the concrete has sufficiently hardened, the side forms are removed from the stationary casting surface to expose the slab which can then be removed from the casting surface and transported to the work site.

Although such an apparatus works well for forming concrete slabs of a single height, the time required to attach and reattach the side forms as well as the time required to attach side forms of various heights to create slabs of different thicknesses, is laborious and costly. For casting surfaces extending hundreds of feet, the changing of side forms to mold slabs of varying depth often requires many hours of down time in which the casting surface is not being used efficiently. Accordingly, it is desirable to provide a casting surface with variable height side forms to reduce the amount of time and labor required in varying the depth of the mold. It is also desirable to provide side forms which can be quickly and easily removed from the sides of the hardening slab to provide easy removal of the slab from the casting surface.

The difficulties in the prior art are substantially eliminated by the present invention.

SUMMARY OF THE INVENTION

Accordingly, it is an object of the present invention to provide a concrete casting surface with variable height side forms which allow the depth of the concrete mold to be quickly varied to an appropriate height.

It is another object of the present invention to provide a concrete mold apparatus wherein the side forms may be quickly and easily removed from a hardening concrete slab to allow removal of the slab from the casting surface.

Yet another object of the present invention is to provide a concrete mold apparatus wherein the side forms of the apparatus may be lowered to a point where a hardened slab may be slid laterally over the side forms for easy removal of the slab from the apparatus.

It is still another object of the present invention to provide a sturdy side form arm assembly which maintains the side form firmly against the side of the stationary casting surface throughout the molding process.

By the present invention, it is proposed to overcome the difficulties encountered heretofore. To this end, a concrete mold apparatus is provided with a casting surface having a side form.

The mold apparatus is also provided with means for moving the side form vertically in relationship to the casting surface to facilitate the molding of articles having various thicknesses. In the preferred embodiment of the invention, means are provided for moving the side form into and out of engagement with the side of the casting surface to allow a slab molded within the concrete mold apparatus to be more easily removed from the casting surface.

DETAILED DESCRIPTION OF THE INVENTION

In the figures, a concrete forming apparatus 10 is shown having a casting surface 12 and a pair of side forms 24 which may be varied in height in relationship to the casting surface 12 to vary the depth of the concrete forming apparatus 10.

Figure 1:
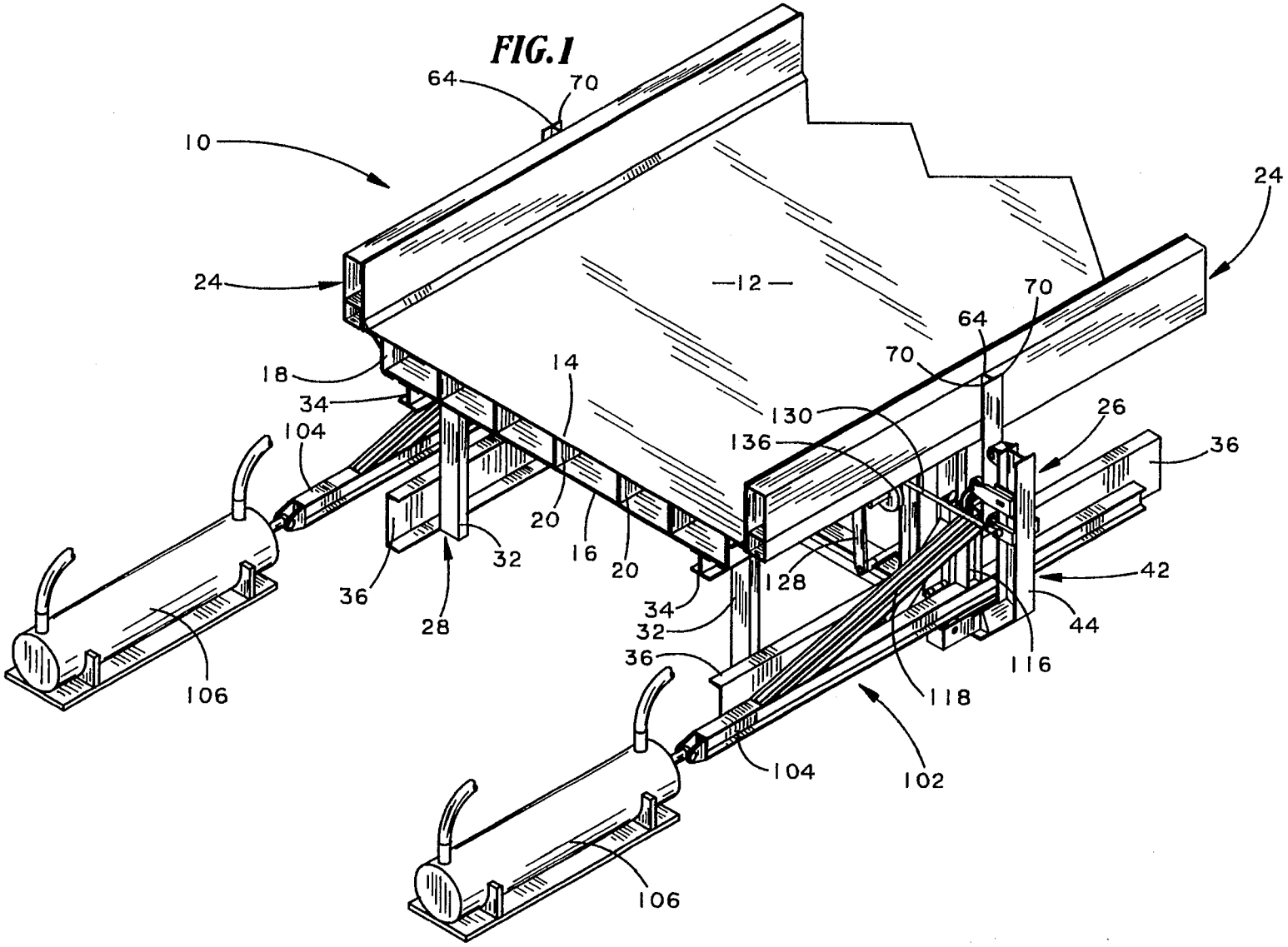
FIG. 1 is a perspective view showing cylinders used to pull sloped tracks of the present invention.
Figure 4:
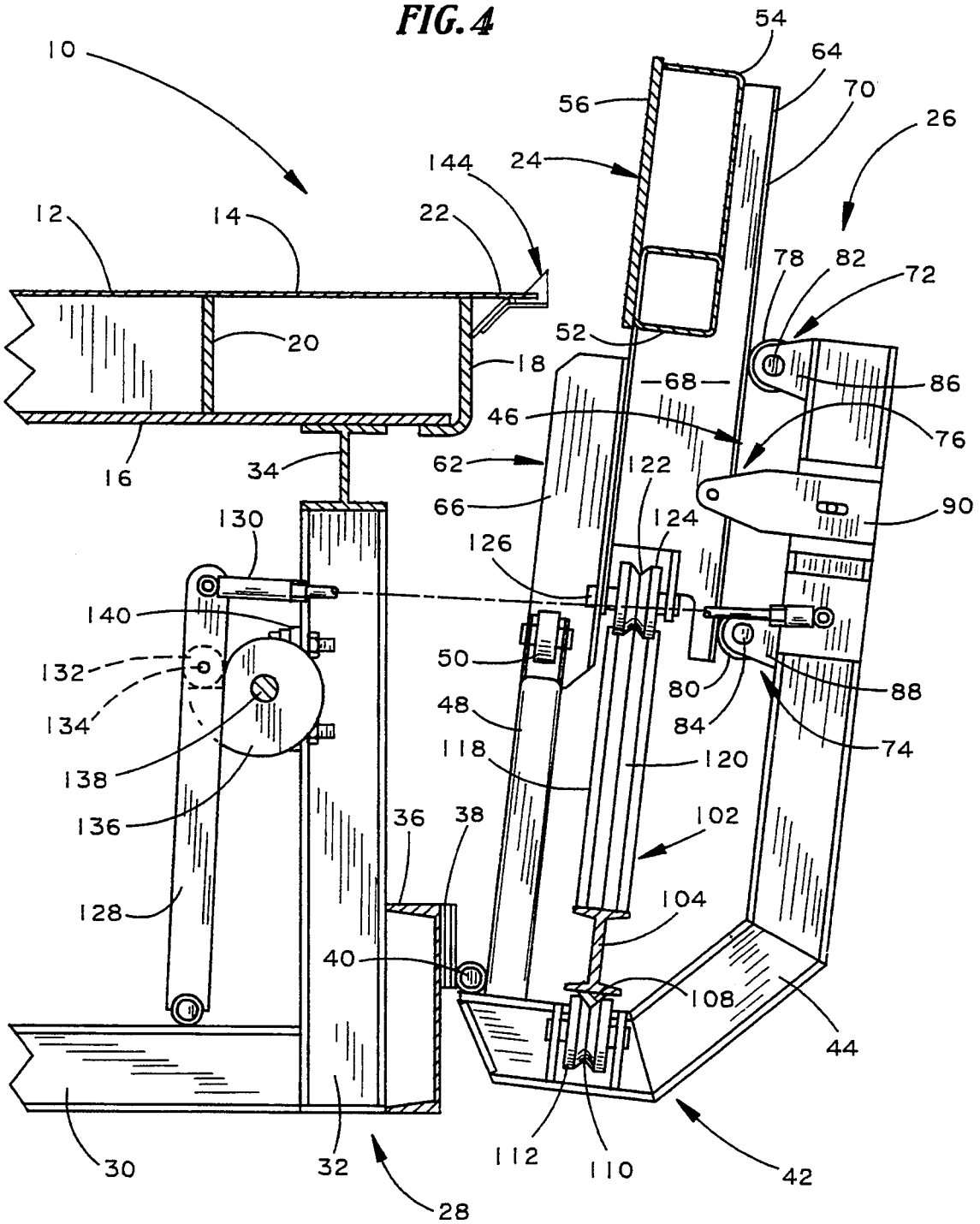
FIG. 4 is a front elevational view of the present invention showing the side form raised and moved away from a casting surface.

Preferably, the concrete forming apparatus 10 consists of a casting surface 12, a support structure 28, and two side form assemblies 26 (FIG. 1). The casting surface 12 is preferably constructed of a steel plate, but may, of course, be constructed of any material suitable for casting concrete. The casting surface 12 is supported on a support structure 28 consisting of a plurality of I-beams 30–34 which are welded together to maintain the casting surface 12 a predetermined distance from the ground (FIG. 4). The ground beams 30 are preferably bolted or otherwise secured to the ground to prevent the concrete forming apparatus 10 from moving during the molding process. A plurality of riser beams 32 are secured to the ground beams 30 by bolts or similar securement means. A series of connector beams 34 oriented perpendicularly with respect to both said ground beams 30 and said riser beams 32 are secured to both the riser beams 32 and the casting surface 12 to secure the casting surface 12 at a predetermined height and orientation throughout the molding process.

The casting surface 12 is preferably constructed of steel sheeting formed into a long rectangular hollow box-like construction (FIG. 4). The casting surface 12 has both a top 14 as well as a bottom 16 and sides 18. Preferably, a series of internal supports 20 are welded throughout the interior of the casting surface 12 and connected by weldments or similar securement means to both the top 14 and the bottom 16 of the casting surface 12 to prevent the top 14 from collapsing into the bottom 16 as concrete is poured onto the casting surface 12. The top 14 of the casting surface 12 is preferably constructed with a cantilevered portion 22 extending over the sides 18 of the casting surface 12. The cantilevered portions 22 are provided to provide added clearance for the side forms 24 and side form assemblies 26 to avoid contact with the sides 18 of the casting surface 12 and the support structure 28.

Connected to the riser beams 32 is a side form assembly support 36 which is preferably connected to the riser beams 32 by weldments. Extending from the side form assembly support 36 of the riser beams 32 is a shim pack 38. The shim pack 38 of the riser beam 32 can be increased or decreased in size to more closely align the side form 24 perpendicularly with the top 14 of the casting surface 12. Connected to the shim pack 38 is a hinge assembly 40 which connects a side form arm 42 to the support structure 28. The side form arm 42 is composed of a J-arm 44, a roller assembly 46, and a roller support 48. The side form 24 is slidably coupled to the side form arm 42 by means of the roller assembly 46 and the lateral roller 50.

The side form 24 is constructed of a hollow steel beam 52 having a square cross-section connected to a substantially L-shaped steel plate 54 running the length of the beam 52 (FIG. 4). A length of steel 56 is then connected from the top portion of the steel plate 54 to the top of the hollow steel beam 52 to form the side form 24 of a substantially rectangular cross-section. In the preferred embodiment of the present invention, steel supports 60 (not shown) are welded at spaced intervals throughout the interior of the side form 24 to further strengthen the side form 24.

Figure 7:
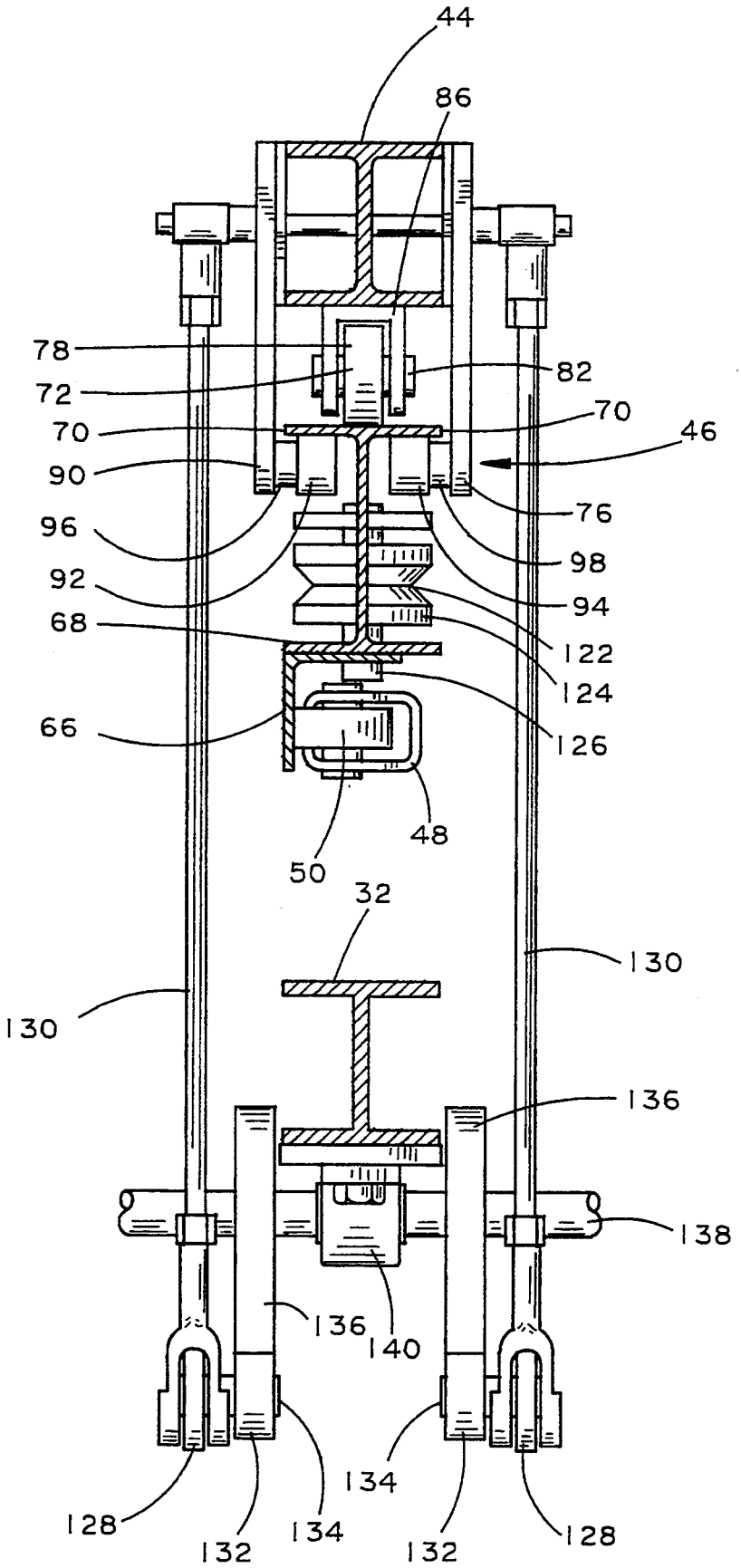
FIG. 7 is a top plan cutaway view of the present invention taken along lines 7—7 showing tie bars connecting a pull bar to a side form arm.

In the preferred embodiment of the present invention, side form supports 62 are welded to the side form 24 at 8 foot intervals. The side form supports 62 are preferably constructed of a pair of parallel stanchions separated by a center connector 68. The upper stanchion 64 is preferably provided with a pair of flanges 70 extending outward from the sides of the upper stanchion 64 (FIGS. 1 and 4). The flanges 70 provide a track for the roller assembly 46, consisting of upper and lower outer rollers 72 and 74 and a center inner roller 76 (FIG. 4). The upper and lower outer rollers 72 and 74 consist of single wheels 78 and 80 and are connected by means of axles 82 and 84 to axle supports 86 and 88 which are welded to the J-arm 44. A center axle support 90 is welded to the J-arm 44 and extends beyond the flanges 70. A pair of wheels 92 and 94 are connected by axles 96 and 98 to the center axle support 90 (FIG. 7). The upper and lower outer rollers 72 and 74 prevent the side form 24 from moving toward the J-arm 44, while the inner rollers 92 and 94 prevent the side form 24 from moving away from the J-arm 44 (FIGS. 4 and 7). The rollers 72, 74, 92 and 94 thereby allow the side form 24 to move upward and downward relative to the J-arm 44 while maintaining the side form 24 substantially parallel to the J-arm 44. In the preferred embodiment of the present invention, the center axle support 90 is adjustable relative to the J-arm 44 to increase or decrease the ease with which the side form 24 slides up and down relative to the casting surface 12.

The lower stanchion 66 is of a substantially L-shaped cross-section with one side in contact with the lateral roller 50 mounted to the top of the roller support 48 and the other side secured to the center connector 68. The roller 50 contacts the lower stanchion 66 thereby preventing the side form 24 from being laterally displaced relative to the J-arm 44 as the side form 24 is moved upward and downward by a sloped track 102 (FIG. 4).

The sloped track 102 is preferably constructed of an I-beam 104 which is somewhat longer than the casting surface 12 so that a portion of the I-beam 104 extends beyond the casting surface 12 to allow easy attachment of the I-beam 104 to a hydraulic cylinder 106 or similar linear actuator (FIG. 1). A steel chamfer strip 108 is welded to the bottom of the I-beam 104 (FIG. 4). The chamfer strip 108 rides along races 110 provided in rollers 112 journaled to the lower portion of the J-arm 44 to allow the I-beam 104 to be pulled laterally in relationship to the J-arm 44.

Figure 2A:
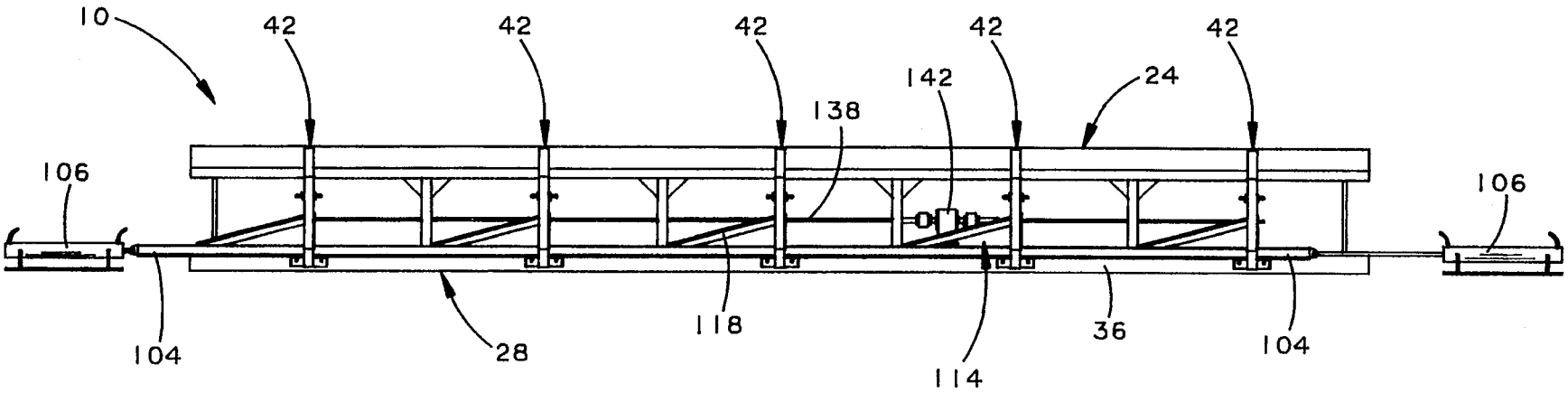
FIG. 2*a* is a side elevational view of the present invention showing a side form at its highest position.
Figure 2B:
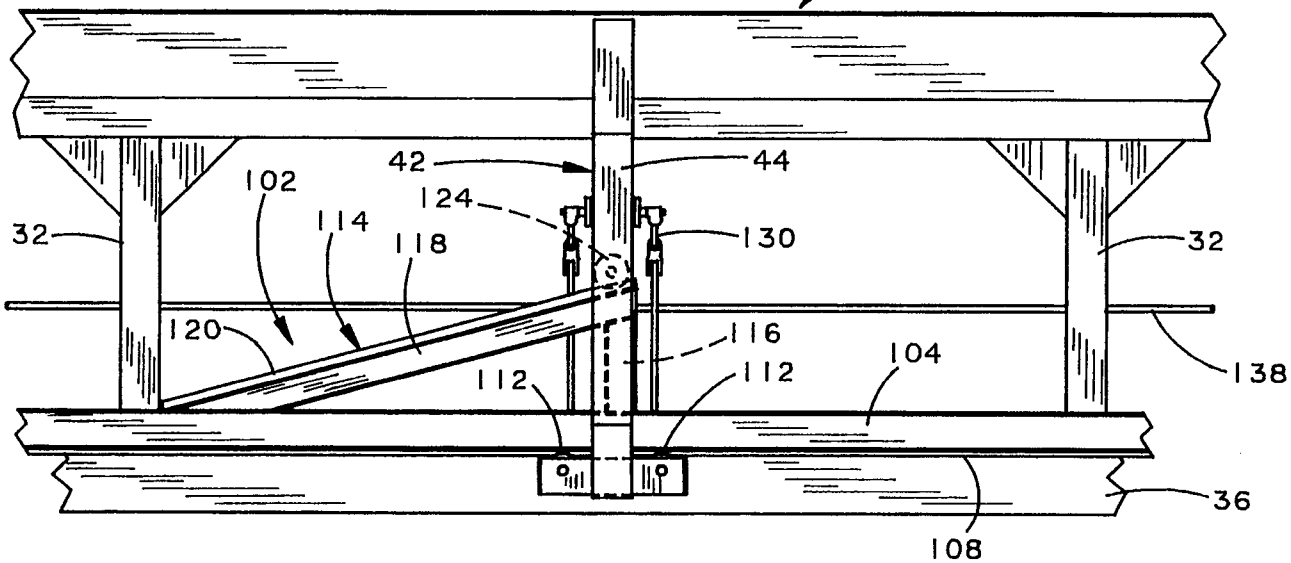
FIG. 2*b* is an enlarged view of a portion of FIG. 2*a;*
Figure 3A:
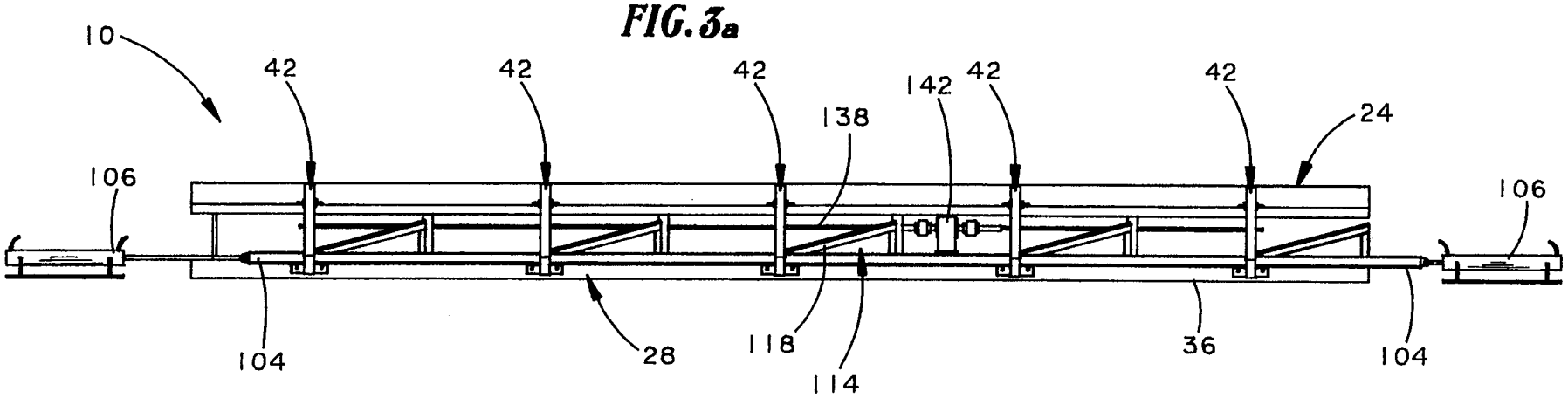
FIG. 3*a* is a side elevational view of the present invention showing the side form at its lowest position.
Figure 3B:
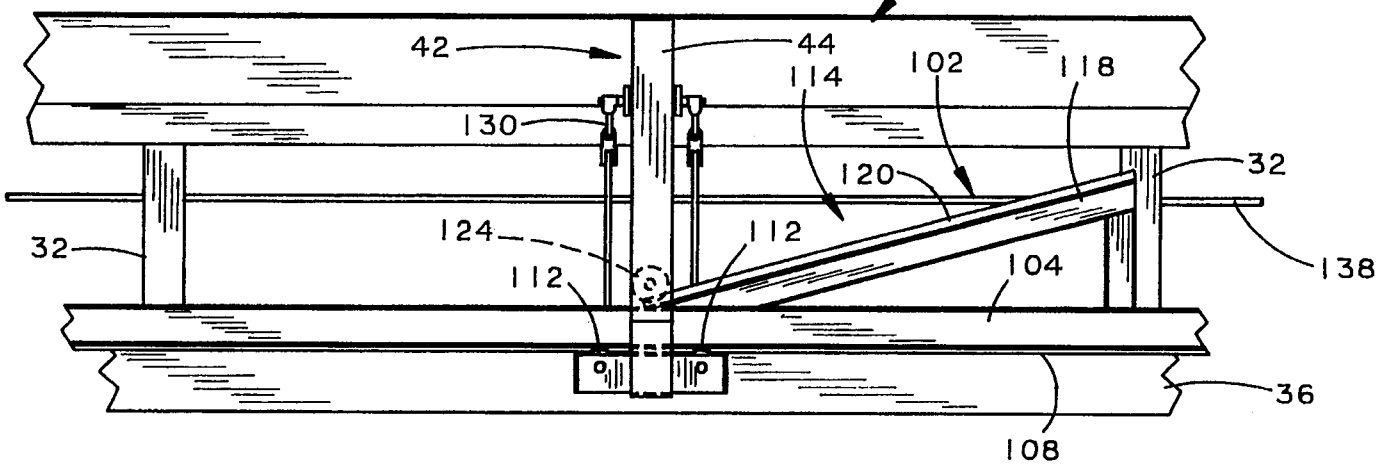
FIG. 3*b* is an enlarged view of a portion of FIG. 3*a;*

Approximately every four feet along the top of the I-beam 104 is a sloped lift 114 consisting of a vertical I-beam 116 welded to the horizontal I-beam 104 and an inclined I-beam 118 welded to both the horizontal I-beam 104 and the vertical I-beam 116 (FIGS. 2*a–b*). The inclined I-beam 118 spans approximately four feet of the horizontal I-beam 104 thereby placing the sloped lifts 104 about four feet from one another. A second steel chamfer strip 120 is welded to the top of the inclined I-beam 118 to allow the sloped lift 114 to move within the races 122 provided within the roller 124 connected by an axle 126 secured to both the upper and lower stanchions 64 and 66 (FIGS. 1 and 4).

Pivotally mounted to the ground beam 30 is a pull bar 128 (FIGS. 4 and 7). The pull bar 128 preferably consists of a pair of steel rods which extend upward and are operably connected at their upper end to the J-arm 44 by means of a pair of tie rods 130. Connected to the pull bar 128 between the ground beam 30 and the tie rod 130 are a pair of rollers 132 which are connected to the pull bar 128 by means of a pair of axles 134. The rollers 132 are in operable engagement with a pair of cams 136 which are secured to a shaft 138 running parallel to the I-beam 104. A shaft guide 140 is secured by bolts to the riser beam 32. The shaft guide 140 surrounds the shaft 138 and permits the shaft 138 to rotate while preventing the shaft 138 from moving upwards, downwards, or laterally in relationship to the riser beam 32.

Figure 5:
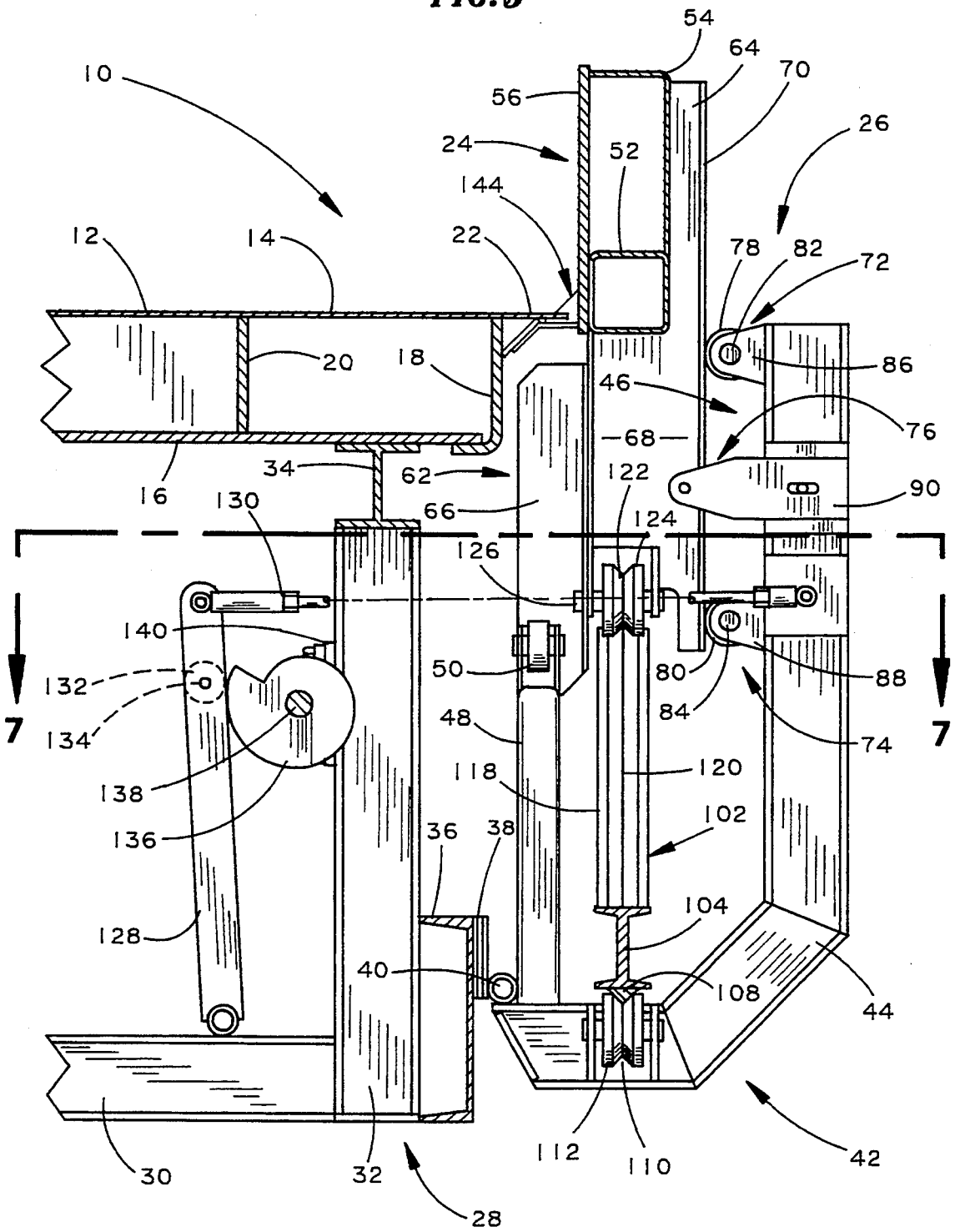
FIG. 5 is a front elevational view of the present invention showing the side form raised and in contact with the side of the casting surface.

An electric motor 142 is positioned near the center of the concrete forming apparatus 10 and operates to rotate the shaft 138 (FIG. 2*a*). As the shaft 138 rotates, the cams 136 move against the rollers 132 and thereby move the rollers 132 and pull bars 128 either away from or toward the riser beam 32 depending on the direction the shaft 138 is being rotated (FIG. 4). The cams 136 are of a substantially nautiloid shape so that as the cams 136 are rotated, the top of the pull bar 128 begins at a position close to the riser beam 32 and slowly moves outward to a fully extended position away from the riser beam 32 (FIG. 5). The top of the pull bar 128 is connected by means of the tie rods 130 to the J-arm 44, which is connected by means of the roller assembly 46 to the side form 24 (FIG. 4). As the cams 136 are rotated and the pull bar 128 is moved away from the riser beam 32, the side form 24 is moved into engagement with the side 18 of the casting surface 12 (FIG. 5). A cant strip 144 preferably of a resilient material such as rubber is secured to the side 18 of the casting surface 12 to allow the side form 24 to securely contact the casting surface 12. Alternatively, the cant strip 144 could be made of a rigid material such as steel and could be secured to the top 14 of the casting surface 12.

To begin the molding process, the side form 24 is set at the desired height for the particular article being molded. This is accomplished by pulling or pushing the sloped track 102 with the hydraulic cylinder 106 until the side form 24 has travelled upward or downward on the races 122 of the rollers 124 along the steel chamfer strip 120 of the inclined I-beams 118 (FIGS. *2a–b* and *3a–b*). During this operation, the upper and lower outer rollers 72 and 74 and the center inner rollers 76 maintain the side form 24 at the desired position and prevent the side form from moving to a position which is not parallel with the J-arm 44 (FIG. 4). Similarly, the lateral roller 50 prevents the sloped track 102 from moving laterally relative to the J-arm 44. All of the rollers 50, 72, 74, 76, 78 and 80 coact to stabilize the side form 24 as the side form 24 is being raised or lowered.

After the side form 24 has been moved to a sufficient height, the electric motor 142 is engaged to rotate the shaft so that the rollers 132 connected to the pull bar 128 begin to move along the cams 136, thereby pivoting the top portion of the pull bar 128 away from the riser beam 32 (FIGS. 2 and 5). This action causes the tie rods 130 connected to the pull bar 128 to move the J-arm 44 toward the riser beam 32. The shaft 138 is rotated until the side form 24 has come into contact with the side 18 of the casting surface 12 (FIG. 5). Preferably, the cams 136 are designed so that when the side form 24 has come into contact with the casting surface 12, the portion of the cams 136 contacting the rollers 132 are of a constant curvature to prevent the rollers 132 from moving back along the cams 136 and allowing the side form 24 to move away from the cant strip 144 of the casting surface 12 during the molding process. Such a constant curvature diameter is not, however, required on the smaller diameter end of the cams 136, as the rollers 132 are braced by the notches 146 in the cams 136. These notches 146 prevent the J-arm 44 and side form 24 from extending too far away from the side of the casting surface 12.

Once the side form 24 has been moved to the desired height and brought into contact with the cant strip 144 of the casting surface 12 concrete is poured on the casting surface 12 in an amount sufficient to substantially fill the concrete forming apparatus 10. After the apparatus 10 has been sufficiently filled, the surface of the concrete is screed and preferably scratched to provide the concrete with the desired finish.

Figure 6:
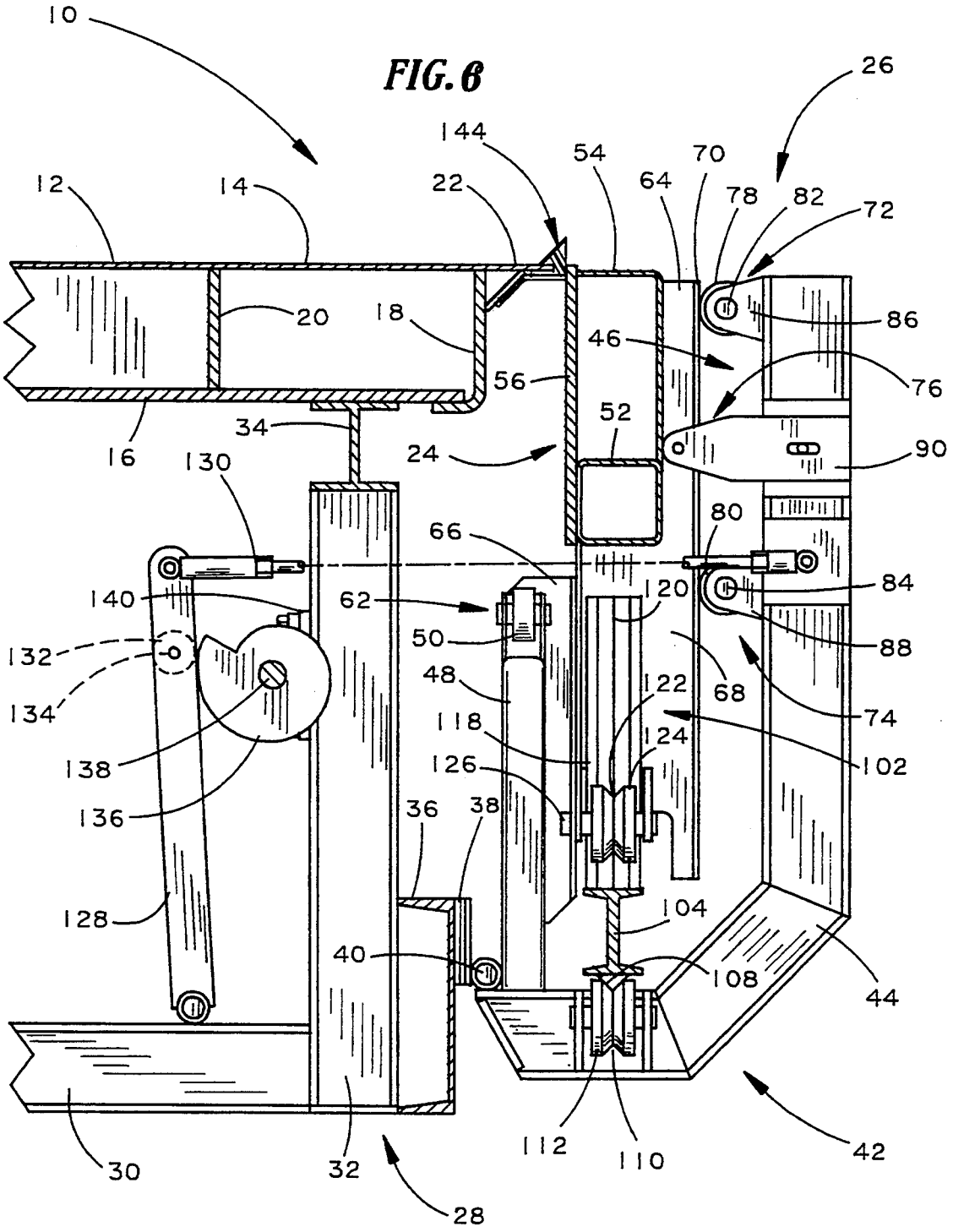
FIG. 6 is a front elevational view of the present invention showing the side form in its lowest position in contact with the side of the casting surface.

After the concrete has sufficiently hardened, the electric motor 142 is engaged to rotate the shaft 138 and thereby move the cams 136 against the rollers 132 (FIGS. 2 and 5). As the pull bar 128 moves toward the riser beam 32, the J-arm 44 and side form 24 move away from the side of the casting surface 12. After the side form 24 has been moved a sufficient distance away from the casting surface 12 the resulting slab may either be removed from the casting surface 12 or the side form 24 may be lowered by actuating the hydraulic cylinder 106 to move the side form 24 downward along the sloped track 102. This lowering of the side form allows the resulting concrete slab to more easily clear the side form 24 as the slab is removed from the casting surface 12 (FIG. 6).

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. For example, the cams 136 may be replaced with an eccentric shaft which is position outside of the side form 24. A support may be also positioned outside of the side form 24 to allow the eccentric shaft to press against and thereby move the side form 24 into and out of engagement with the side 18 of the casting surface 12.

What is claimed is:

1. A concrete mold apparatus for forming poured concrete articles comprising:

(a) a casting surface;

(b) a side form; and (c) a side form arm assembly comprising:

(i) a side form arm;

(ii) a flange having a first side and a second side extending from said side form, said flange being substantially parallel to said side form arm and extending in a plane substantially parallel to said side form;

(iii) a first roller assembly operably connected to said side form arm, said first roller assembly positioned on and in slidable engagement with said first side of said flange; and (iv) a second roller assembly operably connected to said side form arm, said second roller assembly positioned on and in slidable engagement with said second side of said flange wherein said flange is in supported engagement between said first roller assembly and said second roller assembly in a manner which allows said side form to slide, while maintaining a substantially parallel orientation relative to said side form arm.

2. The concrete mold apparatus of claim 1, further comprising a sloped track in slidable engagement with said side form wherein said side form is located along the transverse confines of said casting surface, to raise and lower the side form relative to said transverse confines of said casting surface as the track is moved in substantially horizontal relationship with said side form.

3. A concrete mold apparatus for forming poured concrete articles comprising:

(a) a casting surface having a side;

(b) a side form; and (c) means for moving said side form into and out of engagement with said side of said casting surface to allow articles molded in the concrete mold apparatus to be removed from the apparatus, said moving means comprising:

(i) a side form arm, slidably connected to said side form;

(ii) a pull bar capable of movement relative to said casting surface;

(iii) a tie rod connecting said pull bar to said side form arm;

(iv) a cam shaft operably coupled to said pull bar so that as said cam shaft is rotated, said pull bar moves and transfers said movement to said side form arm and said side form; and (v) means for turning said cam shaft.

4. A concrete mold apparatus for forming poured concrete articles comprising:

(a) a substantially horizontal casting surface;

(b) a pivotal side form arm assembly comprising:

(i) a side form arm;

(ii) a flange having a first side and a second side extending from a side form, said flange being substantially parallel to said side form arm and extending in a plane substantially parallel to said side form;

(iii) a first roller assembly operably connected to said side form arm, said first roller assembly positioned on and in slidable engagement with said first side of said flange; and (iv) a second roller assembly operably connected to said side form arm, said second roller assembly positioned on and in slidable engagement with said second side of said flange wherein said flange is in supported engagement between said first roller assembly and said second roller assembly in a manner which allows said side form to slide, while maintaining a substantially parallel orientation relative to said side form arm;

(c) means allowing said side form arm to pivot in relationship to said casting surface;

(d) wherein said side form is slidably coupled to said side form arm by said first roller assembly and said second roller assembly in a manner which allows said side form to pivot substantially with said side form arm into and out of contact with said casting surface;

(e) means for moving said side form into contact with said casting surface; and (f) means for sliding said side form in relationship to said side form arm.

5. The concrete mold apparatus device of claim 4, further comprising a support connected to said casting surface to maintain said casting surface above the ground.

6. The concrete mold apparatus of claim 5, wherein said means for allowing said side form arm to pivot is a hinge connecting said side form arm to said support.

7. The concrete mold apparatus of claim 4, wherein said means for moving said side form into contact with said casting surface is a tie rod assembly comprising:

i. a support apparatus;

ii. a pull bar having a top and a bottom, said pull bar positioned in a substantially parallel plane with said support apparatus;

iii. a camshaft positioned between said pull bar and said support apparatus;

iv. means for turning said camshaft, said turning means being operably connected to said camshaft; and v. a tie rod having a first end and a second end, said first end being operably connected to said side form arm, said second end being operably connected to said pull bar so that as said camshaft is rotated, said pull bar is moved away from said support apparatus and power is transferred from said pull bar, along said tie rod, to said side form arm thereby moving said side form into contact with said casting surface.

8. A concrete mold apparatus for forming poured concrete articles comprising:

a. a substantially horizontal casting surface;

b. a support structure operably connected to said casting surface;

c. a side form arm pivotably connected to said support structure;

d. a side form slidably coupled to said side form arm to allow said side form to slide in substantially parallel relationship with said side form arm to position said side form at various heights relative to said casting surface;

e. a sloped track slidably coupled to said side form arm to allow said track to slide substantially laterally in relationship to said side form arm, said track also being slidably coupled with said side form to allow said track to slide substantially longitudinally in relationship to said side form, said track being of a construction whereby as said track is moved in a first direction relative to said side form, said side form is raised in relationship to said casting surface, and as said track is moved in a second direction relative to said side form, said side form is lowered in relationship to said casting surface;

f. a pull bar having a top and a bottom, said bottom being operably connected to said support structure in a manner which allows said pull bar to pivot in relationship to said support structure;

g. a tie rod connected between said top of said pull bar and said side form arm in a manner which transfers pivotable movement of said pull bar into movement of said side form arm;

h. a camshaft positioned between said support structure and said pull bar so that as said camshaft rotates, said pull bar moves in relationship to said support structure, thereby causing said side form arm and said side form to move in relationship to said support structure;

i. means for turning said camshaft; and j. means for sliding said track in relationship to said side form to raise and lower said side form.

* * * * *